US008042779B2

(12) United States Patent
Boscolo

(10) Patent No.: US 8,042,779 B2
(45) Date of Patent: Oct. 25, 2011

(54) ARTICLE ATTACHMENT SYSTEM AND DEVICE

(75) Inventor: Alison M. Boscolo, Seattle, WA (US)

(73) Assignee: Outdoor Research Incorporated, Seattle, WA (US)

( * ) Notice: Subject to any disclaimer, the term of this patent is extended or adjusted under 35 U.S.C. 154(b) by 97 days.

(21) Appl. No.: 12/608,560

(22) Filed: Oct. 29, 2009

(65) Prior Publication Data

US 2010/0108846 A1 May 6, 2010

Related U.S. Application Data

(60) Provisional application No. 61/110,477, filed on Oct. 31, 2008.

(51) Int. Cl.
*A47F 5/00* (2006.01)

(52) U.S. Cl. ..... 248/309.1; 211/85.3; 223/87

(58) Field of Classification Search ..... 248/200, 248/309.1, 310, 544, 301; 211/59.1, 88.04, 211/106.01, 113, 85.3; 223/85, 87
See application file for complete search history.

(56) References Cited

U.S. PATENT DOCUMENTS

| | | | |
|---|---|---|---|
| 3,025,958 | A | 3/1962 | Snape |
| 3,215,385 | A | 11/1965 | Rockland |
| 3,310,272 | A | 3/1967 | Brunger |
| 3,378,180 | A | 4/1968 | Singer |
| 4,007,861 | A | 2/1977 | Duester et al. |
| 4,346,825 | A | 8/1982 | Leger |
| 5,193,676 | A | 3/1993 | Gold |
| 5,553,706 | A | 9/1996 | Gold |
| 5,988,373 | A | 11/1999 | Yates |
| 6,010,044 | A | 1/2000 | Hsiao |
| 6,062,521 | A | 5/2000 | Kelley et al. |
| 6,279,820 | B1 | 8/2001 | Collinet |
| 6,481,182 | B1 | 11/2002 | Fuller |

*Primary Examiner* — Ramon Ramirez
(74) *Attorney, Agent, or Firm* — Seed IP Law Group PLLC

(57) ABSTRACT

The present disclosure is directed to a panel for secure display of articles. In one embodiment, a panel is formed of recyclable material and configured to display an article on a holder, the article having a receiving loop integrally formed thereon. The panel includes an internal tab coplanar with the panel and extending into an opening in the panel, the tab having a narrow section defining at least one hook portion extending from the tab, the hook portion abutting an interior edge of the panel, the hook portion cooperating with the interior edge of the panel to allow the loop to be received over the tab and to retain the loop in engagement with the narrow section.

12 Claims, 12 Drawing Sheets

ARTICLE ATTACHMENT SYSTEM AND DEVICE

BACKGROUND

1. Technical Field

The present disclosure relates to packaging for the display of articles and, more particularly, to recyclable header cards for securely displaying articles on racks, hooks, hangers, and the like, and to a system in which an integrally formed receiving loop on the article cooperates with a hooked tab formed on the header card.

2. Description of the Related Art

Non-recyclable packaging on consumer goods contributes to the worldwide problem of post-consumer waste. Current packaging systems for displaying articles at the point of sale require various combinations of materials. For example, products are attached to header cards with various types of fasteners, usually with material dissimilar to the header card material. In many instances the fasteners pass directly through the product in order to attach the product to the header card. This requires the fastener to puncture the product, which at a minimum can compromise the integrity of the product as well as damage the appearance of the product. When such fasteners are removed, they can further damage the product as well as make it difficult to recycle the waste.

Other methods for attaching an item to a header card include adhesive, such as glue, or plastic wrapping. While providing a high level of security for the product, these materials prevent the consumer from easily removing the product from the header card without damaging the product. In addition, it is desirable that products on display at a point of purchase facilitate examination by the consumer. For example, in order to ensure proper fit, consumers will attempt to insert their hand into a glove while the glove is attached to the header card. While some current methods for displaying articles from header cards facilitate trying on small clothing products, they are not environmentally responsible.

BRIEF SUMMARY

The present disclosure is directed to a panel for secure display of articles. In one embodiment, a panel is formed of recyclable material and configured to display an article on a holder, the article having a receiving loop integrally formed thereon. The panel includes an internal tab coplanar with the panel and extending into an opening in the panel, the tab having a narrow section defining at least one hook portion extending from the tab, the hook portion abutting an interior edge of the panel, the hook portion cooperating with the interior edge of the panel to allow the loop to be received over the tab and to retain the loop in engagement with the narrow section.

In another embodiment, the panel has an elongate arcuate opening that separates the interior edge of the panel from the tab by a first distance, and that separates the interior edge of the panel from the hook portion by a second distance that is smaller than the first distance, the opening terminating at first and second enlarged openings, with each enlarged end separating the panel from the tab by a third distance larger than the second distance.

In accordance with another embodiment of the present disclosure, the panel is made of recyclable paper material. The panel may have at least one additional aperture configured to receive a mounting device associated with the holder. Ideally, the size and shape of the panel is based on the features of the article to be displayed. The panel may also be sized and shaped to display article information. Additionally, the panel may be formed to have multiple tabs to display multiple articles.

In accordance with another aspect of the present disclosure, a device for displaying an article that has a receiving loop integrally formed thereon is provided. The device includes a panel having an opening that defines a hooked member in the same plane as the panel, the hooked member having a body with an enlarged head and a smaller neck, the transition between the head and neck defining at least one hook portion that extends from the hooked member, the hook portion cooperating with an interior edge of the panel to retain the receiving loop of the article in engagement with the hooked member. In a further embodiment, the panel is sized and shaped to have multiple hooked members to display multiple articles.

In accordance with yet another aspect of the present disclosure, a display system is provided that includes an article to be displayed, the article having a receiving member formed as a component of the article, a panel, and a tab coplanar with the panel and extending into an opening in the panel, the tab having a neck defining at least one hook portion extending from the tab, the hook portion abutting an interior edge of the panel, the hook portion cooperating with the interior edge of the panel to allow the receiving member to be received over the tab and around the neck to retain the receiving member in engagement with the neck.

In another embodiment, the display system includes a support structure that receives and supports the panel with the article engaged with the panel. Ideally, the panel is sized and shaped to conform to the features of the article to be displayed as well as the features of the support structure.

BRIEF DESCRIPTION OF THE SEVERAL VIEWS OF THE DRAWINGS

The foregoing and other features and advantages of the present disclosure will be more readily appreciated as the same become better understood from the following detailed description when taken in conjunction with the accompanying drawings, wherein.

DETAILED DESCRIPTION

Figure 1:
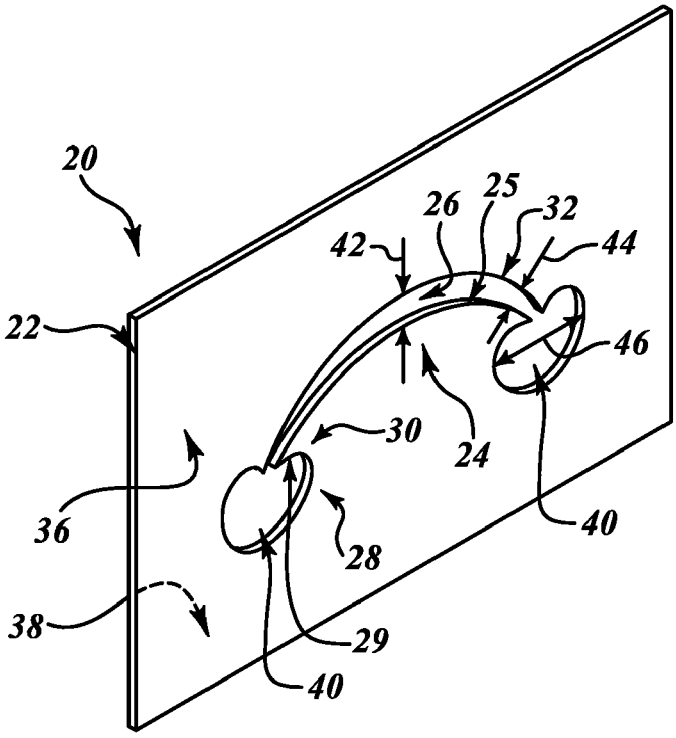
FIG. 1 is an isometric view of a display panel illustrating a hooked tab formed in an opening in the panel, according to one embodiment of the present disclosure.
Figure 2:
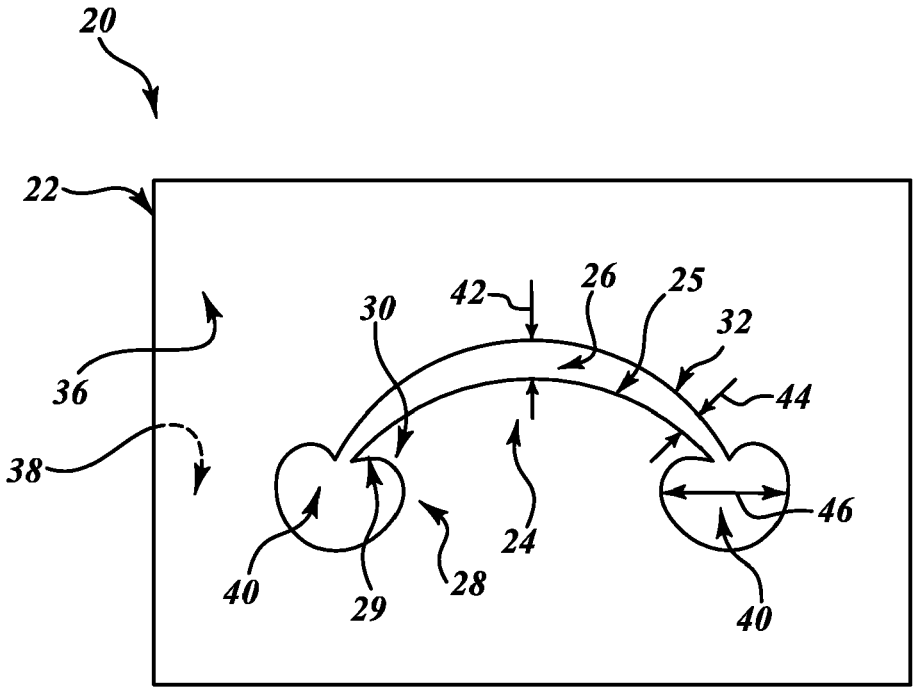
FIG. 2 is the front view of the display panel of FIG. 1.
Figure 3:
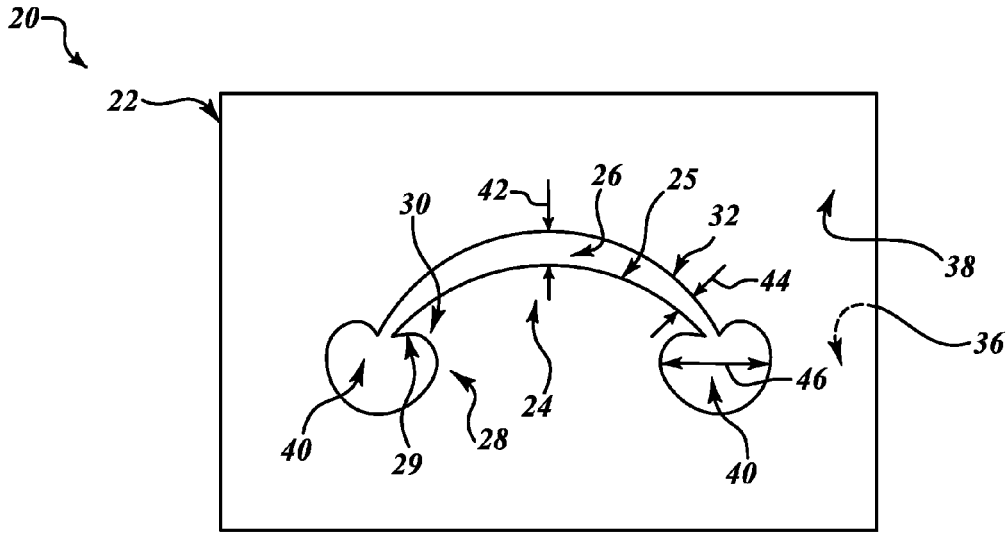
FIG. 3 is the back view of the display panel of FIG. 1.
Figure 4:
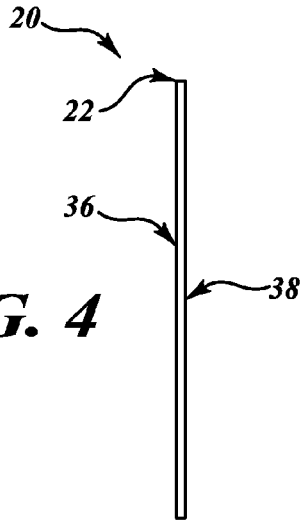
FIG. 4 is the right side view of the display panel of FIG. 1.
Figure 5:
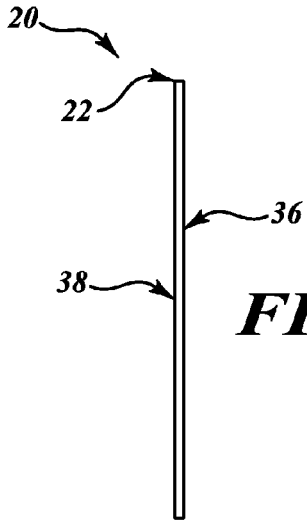
FIG. 5 is the left side view of the display panel of FIG. 1.
Figure 6:
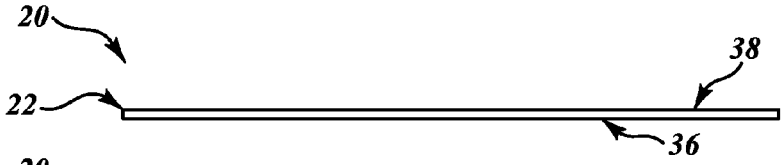
FIG. 6 is the top view of the display panel of FIG. 1.
Figure 7:
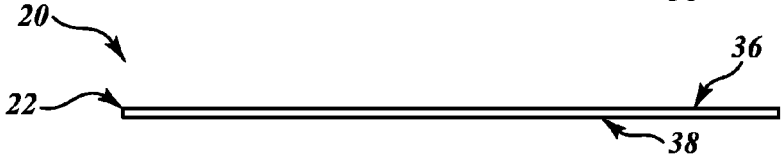
FIG. 7 is the bottom view of the display panel of FIG. 1.

In the following description, certain specific details are set forth in order to provide a thorough understanding of various embodiments of the disclosure. However, one skilled in the art will understand that the disclosure may be practiced without these specific details. In other instances, well-known structures associated with displaying articles for sale such as display racks, support structures for holding the assembled display cards, and methods of manufacture have not been described in detail to avoid unnecessarily obscuring the descriptions of the embodiments of the present disclosure.

Unless the context requires otherwise, throughout the specification and claims that follow, the word "comprise" and variations thereof, such as "comprises" and "comprising," are to be construed in an open, inclusive sense, that is, as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

In the drawings, identical reference numbers identify similar features or elements. The size and relative positions of features in the drawings are not necessarily drawn to scale. For example, the shapes of various features are not drawn to scale, and some of these features are enlarged and positioned to improve drawing legibility.

An embodiment of a recyclable display card system 20 for displaying an article at a point of purchase is illustrated in FIGS. 1-7. The display card system 20 includes a panel 22 formed from a single type of material as described more fully below. The panel 22 includes an internal tab 24 that is sized and shaped to securely display the article without an additional fastener. The article to be displayed is preferably configured to include a loop of material integrally formed with the article. The loop engages with the panel 22 and the tab 24 to display the article. The features of the article and the loop will be described in more detail hereinbelow.

The internal tab 24 is formed coplanar with the panel 22 and extends into an opening 26 in the panel 22. The tab 24 has an exposed edge 25 that is separated from an interior edge 32 of the panel 22 by a first distance 42. A narrow section 28 of the tab 24 defines a hook portion 30 on left and right sides of the tab 24. An extreme edge 29 of the hook portion 30 abuts the interior edge 32 of the panel 22. In other words, the hook portion 30 either touches the interior edge 32 of the panel 22 or is separated from the interior edge 32 of the panel 22 by a second distance 44 that is smaller than the first distance 42. In another embodiment, the second distance 44 is smaller than a thickness of the panel 22.

The opening 26 terminates in opposing first and second enlarged openings 40 that separate the panel 22 from the narrow section 28 of the tab 24 by a third distance 46 that is larger than the second distance 44. In one embodiment, the enlarged openings 40 are formed so that the narrow section 28 is shaped as a curved member. The narrow section 28 of the tab 24 curves to form the hook portion 30 and connects to the panel 22, thus giving the enlarged openings 40 a bulbous or circular shape. The circular shape of the enlarged openings 40 shown in the figures is an aesthetic feature. Any shape that forms a width between the panel 22 and the narrow portion 28 of the tab 24 that is larger than the second distance 44 to adequately engage the loop on the article with the panel 22 will be acceptable.

The panel 22 is preferably constructed from a single recyclable material, thereby providing an environmentally conscious system to transport and display goods at the point of sale without added waste. Strong, durable, and rigid paper-based materials including, but not limited to, cardboard, cardstock, and chipboard are preferable. The use of rigid materials prevents damage to the panel 22 during transport or at the point of sale. The rigidity of the material is important to prevent permanent deformation of the tab 24 during insertion or removal of the loop of material from the panel 22. Although not preferred because of the recycling difficulties, other rigid materials like plastic and metal can be used to manufacture the display card panel 22 disclosed herein.

The size, weight, and thickness of the material used for the panel 22 are selected based on the size, shape, and weight of the article to be displayed. In the case of cardstock, the preferred thickness utilized in the construction of the panel 22 is in the range of about 50 point to about 100 point. A point is the thickness of the sheet of cardstock in thousandths of an inch. For example, a 50 point card is 0.050 inches thick.

The dimensions of the panel 22 may be adjusted to provide additional space for article information, branding, or other types of information. The location of the tab 24 may also vary depending on the desired aesthetic arrangement. Additionally, multiples tabs for displaying multiple articles may be formed coplanar with the panel 22 in a side by side configuration, a diagonal configuration, a stacked configuration, or any other configuration. Ideally the arrangement of the multiple tabs provides for a balance of the weight of the articles that are retained on the panel. More particularly, the arrangement of the tab or tabs 24 is preferably formed to provide balance for the panel 22 when engaged with a display rack.

In a preferred embodiment, the panel 22 is a flat piece of paper-based material with parallel opposing sides or faces, i.e., a front of the panel 36 and a back of the panel 38. However, the hooked tab 22 may be formed on a panel of any rigid material for display including, but not limited to, a folded paper panel, a plastic panel, a wood panel, or a metal panel. The panel is preferably manufactured with a die. However, any method of manufacture may be used to form the hooked tab 24 in the panel 22.

Engagement of the article with the panel 22 requires the material to deform slightly as the loop slides over the tab 24. Preferably the strength and weight of the material prevent the tab 24 from experiencing a permanent deformation during installation or removal of the article. After installation or removal of the article, the tab 24 preferably returns to its original position coplanar with the panel 22. By using a rigid material, the point where the hook portion 30 and the interior edge 32 of the panel 22 are separated by the smallest distance forms a barrier to prevent unintentional removal of the article. Therefore, the hooked tab provides a security function as well as a display function.

Figure 8A:
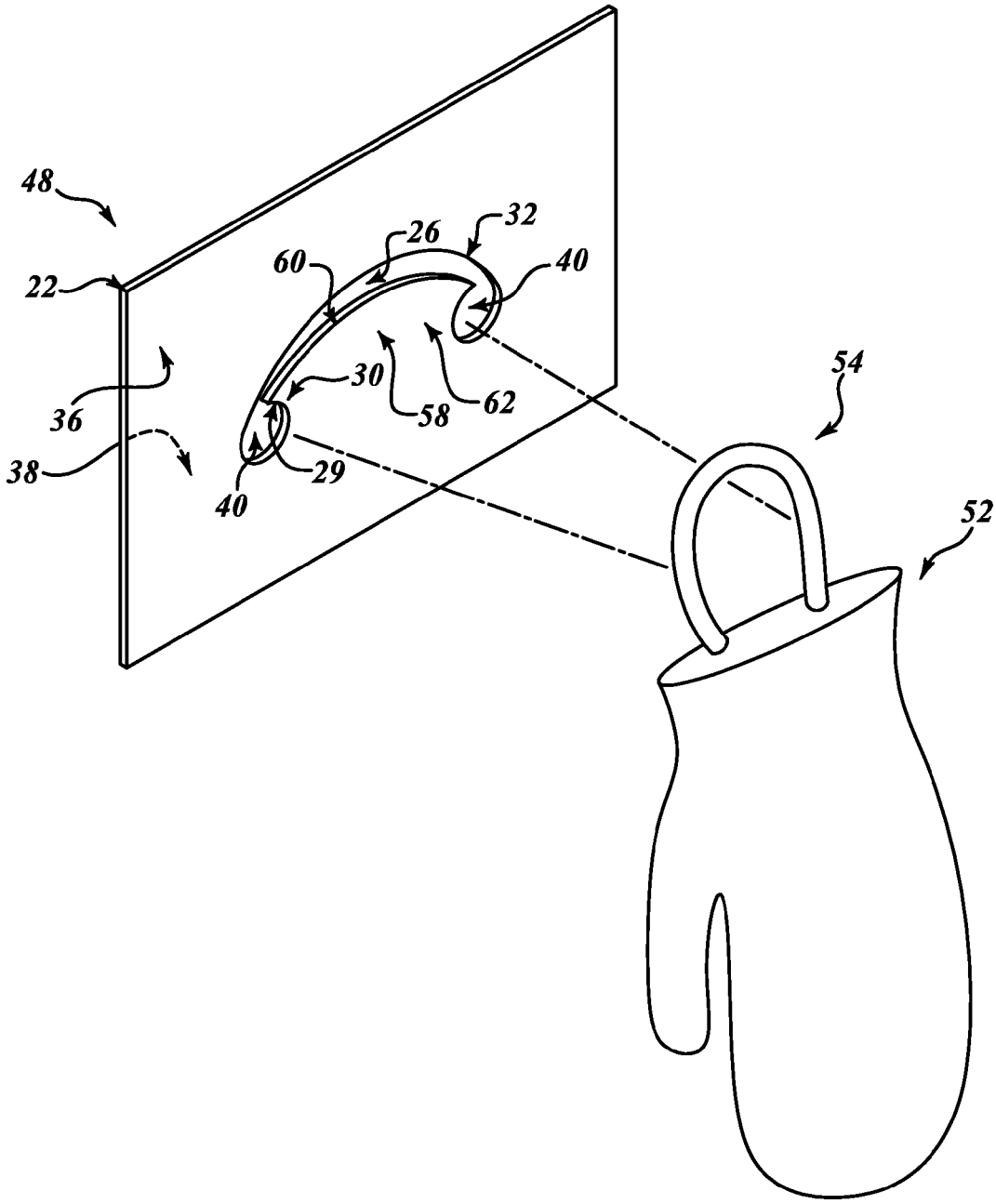
FIG. 8A is an exploded isometric view of a system for displaying an article, according to one embodiment of the present disclosure.
Figure 8B:
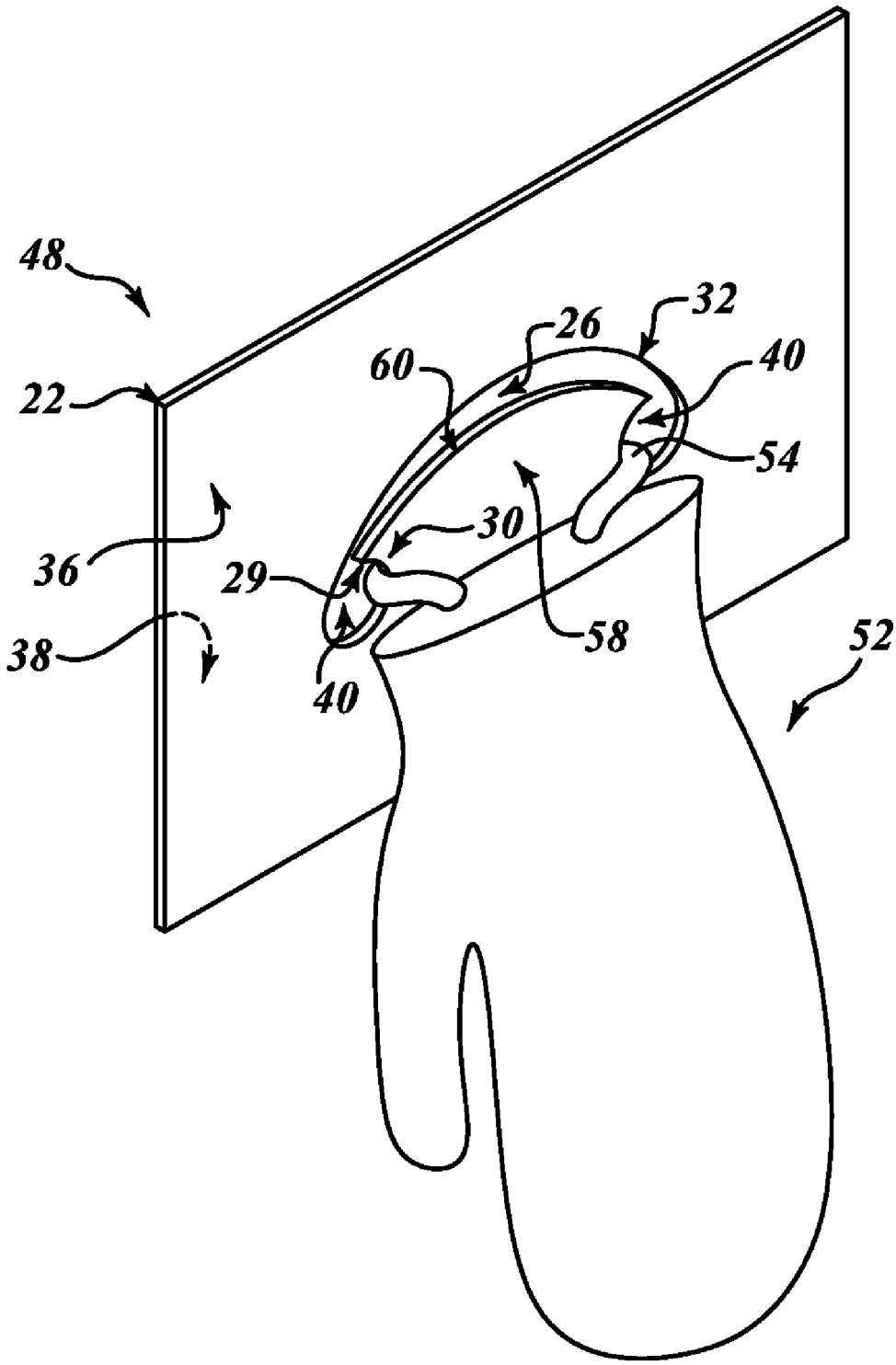
FIG. 8B is the assembled system of FIG. 8A for displaying the article.

FIGS. 8A and 8B illustrate another embodiment of a system 48 for displaying an article, in this case a pair of gloves 52, illustrated as a single glove 52 for clarity. The system 48 includes the pair of gloves 52 and a panel 22 formed to display the gloves 52 without additional fasteners. The gloves 52 are manufactured with a receiving loop 54 integrally formed on the palmar side of the gloves 52. The dimensions, materials, and other details of the loop will be described hereinbelow. Ideally the gloves 52 are mounted to the panel 22 with one glove 52 on one side of the panel 22 and another glove 52 on a reverse side of the panel 22. Displaying the gloves 52 on a front and back side of the panel 22 creates a balanced display. The loops 54 of the gloves 52 rest on top of each other as they are engaged with the tab 24 of the panel 22 from opposite sides (See FIGS. 13A and 13B). The layering of the loops 54 over the tab 24 enhances secure attachment, which in turn enhances security.

As in the previous embodiment, the panel 22 includes a hooked member 58 formed in the same plane as the panel 22. The hooked member 58 has a body with an enlarged head portion 60 that extends into the opening 26. The hooked member 58 also has a neck portion 62 that is narrower than the head portion 60. The transition between the head 60 and the neck 62 forms a hook portion 30 that extends towards the interior edge 32 of the panel 22. The hook portion 30 and the interior edge 32 of the panel 22 cooperate to retain the receiving loop 54 of the glove 52 in engagement with the hooked member 58. More particularly, the hook portion 30 is formed to touch or nearly touch the interior edge 32 of the panel 22 to act as a barrier to unintentional removal of the loop 54 from the panel 22.

The opening 26 is sized and shaped to permit easy engagement of the loop 54 through the opening 26, over the hooked member 58, past the hook portion 30, and into engagement with the enlarged openings 40. The dimensions of the opening 26 and the enlarged openings 40 depend upon the characteristics of the material used to manufacture the loop 54 and the weight of the article to be displayed. In the figures the enlarged openings 40 are illustrated as circular members, however, any shape that provides a third distance 46 larger than the second distance 44 between the neck 62 of the hooked member 58 and the panel 22 will be functional (See, for example, FIG. 14). The diameter of the enlarged openings 40 may be modified for aesthetic purposes and may be significantly larger than the thickness of the loop material. Additionally, the arcuate shape of the opening 26 is an aesthetic feature. The opening 26 may be manufactured in any shape that allows the loop 54 to pass over the head 60 of the hooked member 58 to engage with the enlarged openings 40.

Ideally, the enlarged openings 40 are oriented symmetrically on the panel 22. The specific location of the enlarged openings 40 on the panel 22 is dependent upon the size, weight, and type of article to be displayed, the amount of marketing information desired, and the characteristics of the loop material integrally formed with the article. The enlarged openings 40 are preferably formed at equal distances from the right and left edges of the panel 22 to facilitate balanced display of the article when engaged with the panel 22. The position of the enlarged openings 40 from a top and bottom of the panel 22 varies based on the factors listed above including the weight of the article, the amount of article or merchandising information, the number of articles, as well as other aesthetic reasons. The distance from the edges and bottom of the panel 22 to the enlarged openings 40 must be large enough to ensure the weight of an engaged article will not affect the integrity of the panel 22.

Figure 9A:
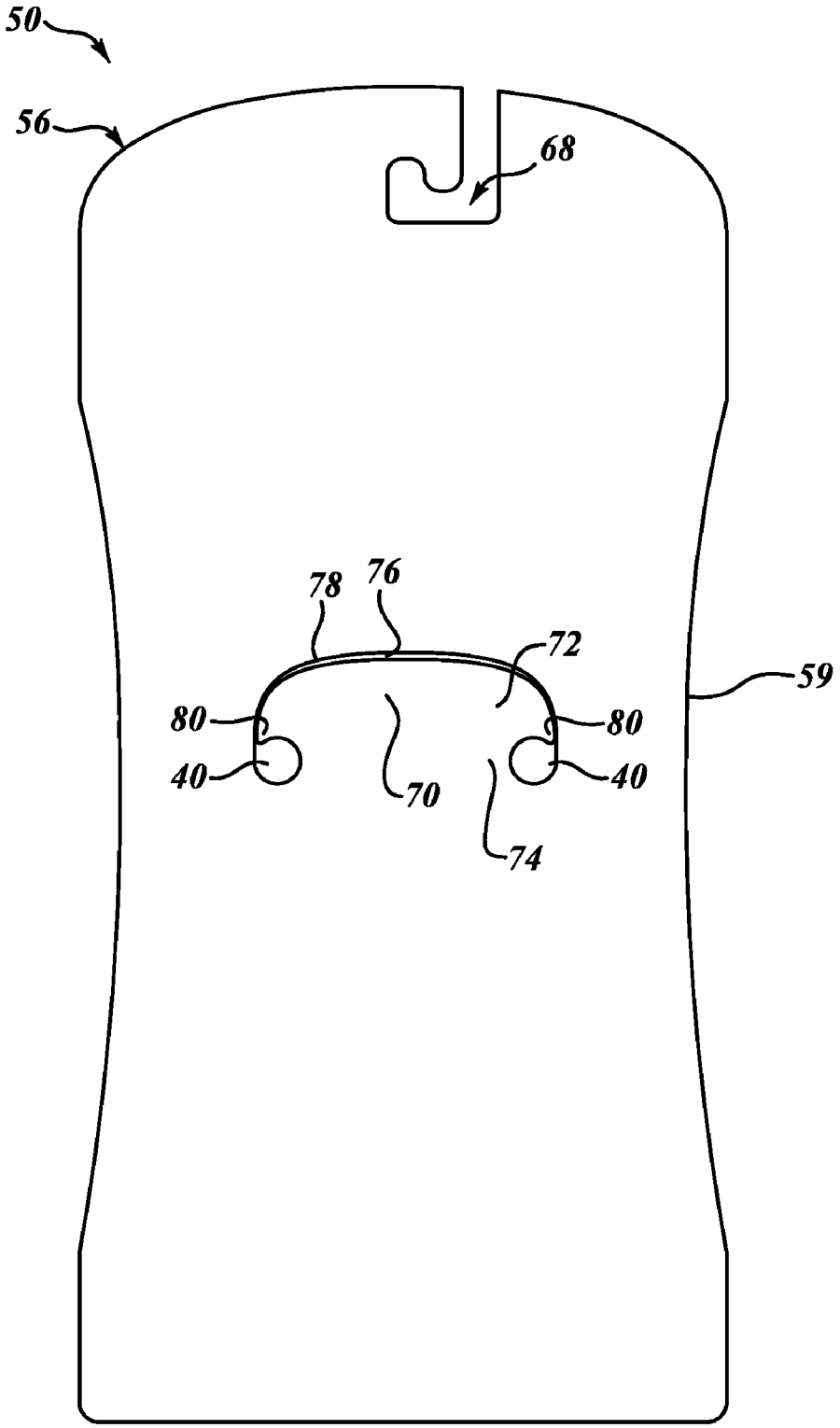
FIG. 9A is a front view of a small display panel according to one embodiment of the present disclosure.
Figure 9B:
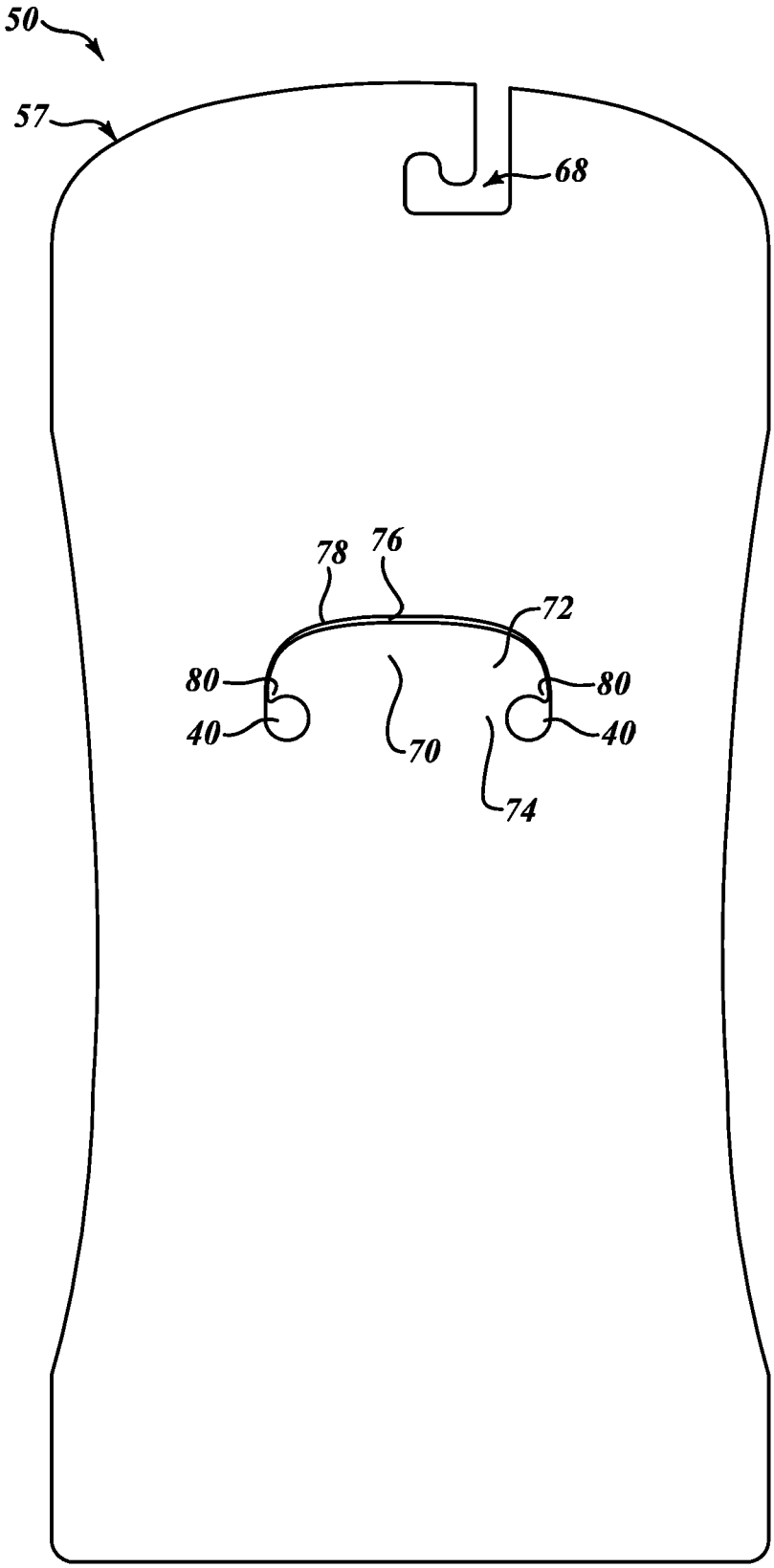
FIG. 9B is a front view of a large display panel according to one embodiment of the present disclosure.

FIGS. 9A and 9B illustrate two sizes of a display card system 50, a small panel 56 and a large panel 57, according to the present disclosure. In FIG. 9A, the display card system 50 includes the panel 56 sized and shaped to display a glove (not shown), FIG. 9B illustrates the larger panel 57 for the display card system 50. An aperture 68 for mounting the panel 56, 57 on a display rack is formed on a top edge of the panel 56, 57. The aperture 68 may be formed at various locations on the panel 56, 57 and in various sizes as well as different numbers to accommodate the mounting system. In this embodiment, a width of the panel 56, 57 is in the range of about 4 inches and about 5.5 inches. A height of the panel 56, 57 is in the range of about 9 inches and about 11 inches.

As shown in FIGS. 9A and 9B, a tab 70 has an enlarged head portion 72 and a narrowed neck portion 74 that are formed to be coplanar with the panel 56, 57. The tab 70 extends into a central opening 76 that is partially defined by an interior edge 78. The head portion 72 of the tab 70 has hook portions 80. The central opening 76 terminates below the hook portions 80 in enlarged openings 40, which have an alternative circular shape. The interior edge 78 of the opening 76 is in a substantially parallel orientation to an exterior edge 59 on the panel 56, at a position where the hook portions 80 abut the interior edge 78. At a position past the hook portions 80, the interior edge 78 begins to curve inward to form the enlarged openings 40 that define the neck portion 74 of the tab 70. In this embodiment, the enlarged openings 40 do not extend past a maximum width of the head portion 72 that occurs at the hook portions 80. Instead, the enlarged openings 40 only extend inward to form the neck portion 74. The radius of curvature of the central opening is not circular, but has an elongate arcuate shape.

In FIG. 9A, the tab 70 is illustrated as centrally positioned on the panel 56. In contrast, in FIG. 9B, the tab 70 is illustrated as positioned in an upper half of the panel 56. The location of the tab 70 in the panel 56, 57 may be varied to accommodate articles of different weights to be displayed by the system 50.

Figure 10A:
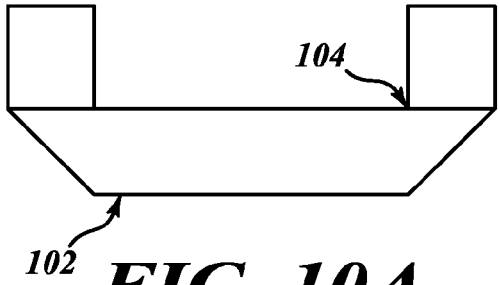
FIG. 10A is an embodiment of a loop to be formed on an article.
Figure 10B:
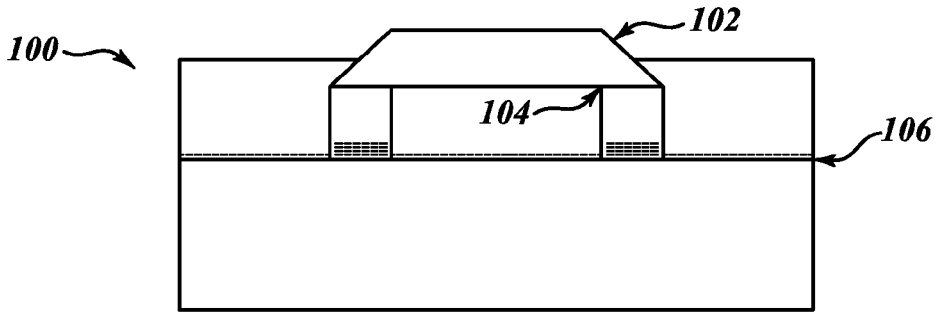
FIG. 10B is the loop of FIG. 10A assembled on an interior hem of the article.

FIGS. 10A and 10B illustrate dimensions of a loop 102 and a placement of the loop 102 on an article 100 in accordance with one embodiment of the present disclosure. The loop 102 is formed of a flat, wide fibrous material that is turned at a right angle 104 and stitched into an interior hem 106 of the article 100. The loop 102 forms an extension from the article 100 that cooperates with the opening 26 and the hook portion 30 to retain the article in engagement with the panel 22 of FIGS. 1-7.

Figure 11A:
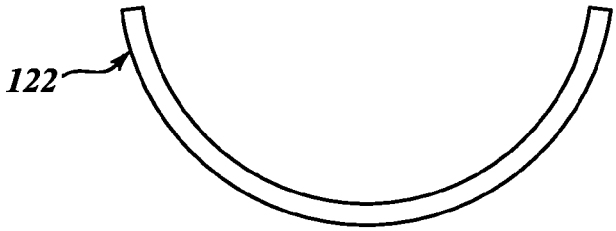
FIG. 11A is an alternate embodiment of a loop to be formed on an article.
Figure 11B:
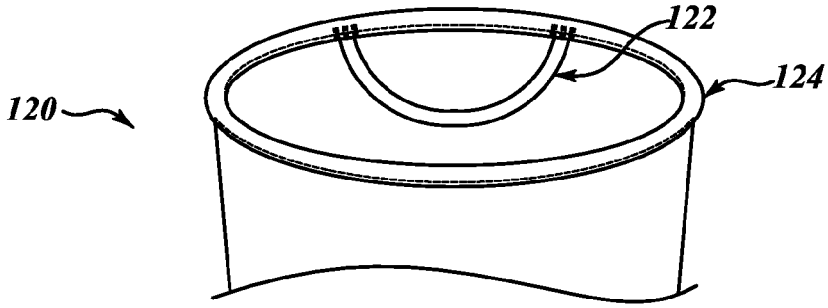
FIG. 11B is the loop of FIG. 11A assembled on an interior cuff of a glove.

FIGS. 11A and 11B illustrate dimensions of a loop 122 and the placement of the loop 122 on a glove 120 in accordance with another embodiment of the present disclosure. The loop 122 is a tubular material attached to the palmar side of a cuff 124 of the glove 120 using techniques well-known in the art. The location of the loop 122 serves a secondary purpose to assist a user in pulling the glove onto the user's hand.

The loop 102, 122 is preferably constructed from flexible filament or flexible material to facilitate engagement of the article with the panel. The dimensions of the loop may vary depending upon the size and weight of the article to be displayed. The loop may be configured by various methods including, but not limited to, the following: flat woven, tubular woven, flat knit, tubular knit, braided, cut and sewn strips of woven fabric, cut and sewn strips of knit fabric, and non-woven materials. The loop may be bonded or laminated to strengthen the loop and prevent fraying of the material. The loop may be constructed from various types of materials including, but not limited to the following: fibers (i.e., nylon, polyester, polypropylene, cotton, wool, Kevlar, Nomex, and lycra), leather, plastic, rubber, polyurethane, thermoplastic polyurethane, thermal plastic rubber, thermoplastic elastomer, Hypalon, nitrile, silicone, metal braid, metal chain, or neoprene.

The loop is preferably sown onto the article as an integral component of the article to prevent unintentional detachment of the loop from the article. However, other attachment methods may be used including, but not limited to, glue, adhesive, or heat welding. The loop is preferably attached to extend beyond the outer boundary of the article to enable the article to hang approximately parallel with the front and back sides of the panel.

In an alternate embodiment, the article is manufactured to include a slit formed in the material for receipt over the tab 24. The slit is sized and shaped to cooperate with the hook portion 30 of the tab 24 and the interior edge 32 of the panel 22 to engage the article with the panel 22. In the case of a glove, a slit is formed on the palmar side of the cuff of the glove to enable secure display on the panel 22. As mentioned above with regard to the loop 122, the slit functions as a pull to assist a user in putting the glove on the user's hand.

The display card system 20, 48, 50 is configured to display any article that may be manufactured to have a receiving loop formed as a component thereon including, but not limited to, headwear, gaiters, backpacks, bags, garden tools, lightweight footwear, clothing, neckwear, ropes, bungee cords, hoses, wires, socks, scarves, shirt, pants, or goggles.

Figure 12A:
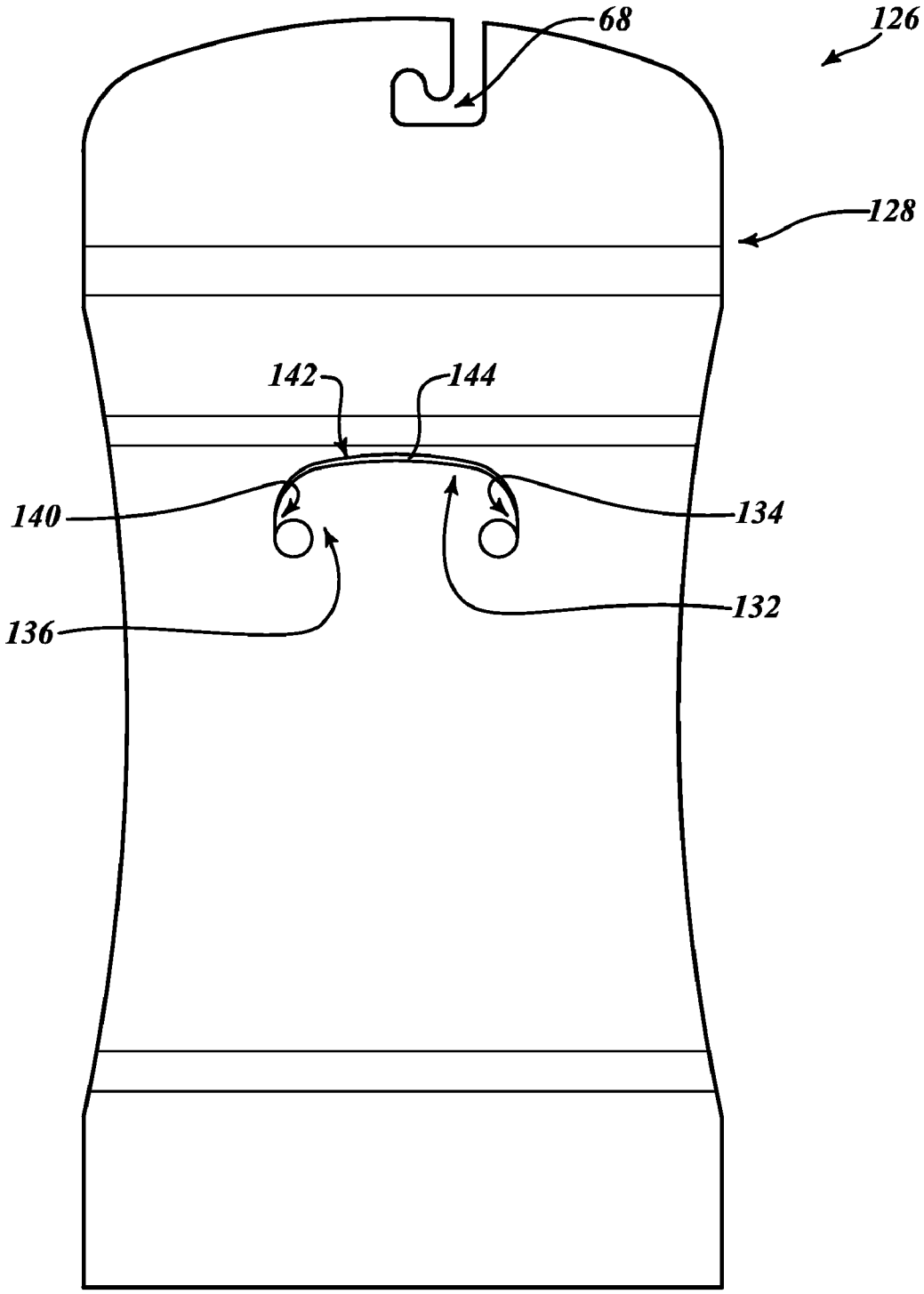
FIG. 12A is a front view of a commercial embodiment of the display card.
Figure 12B:
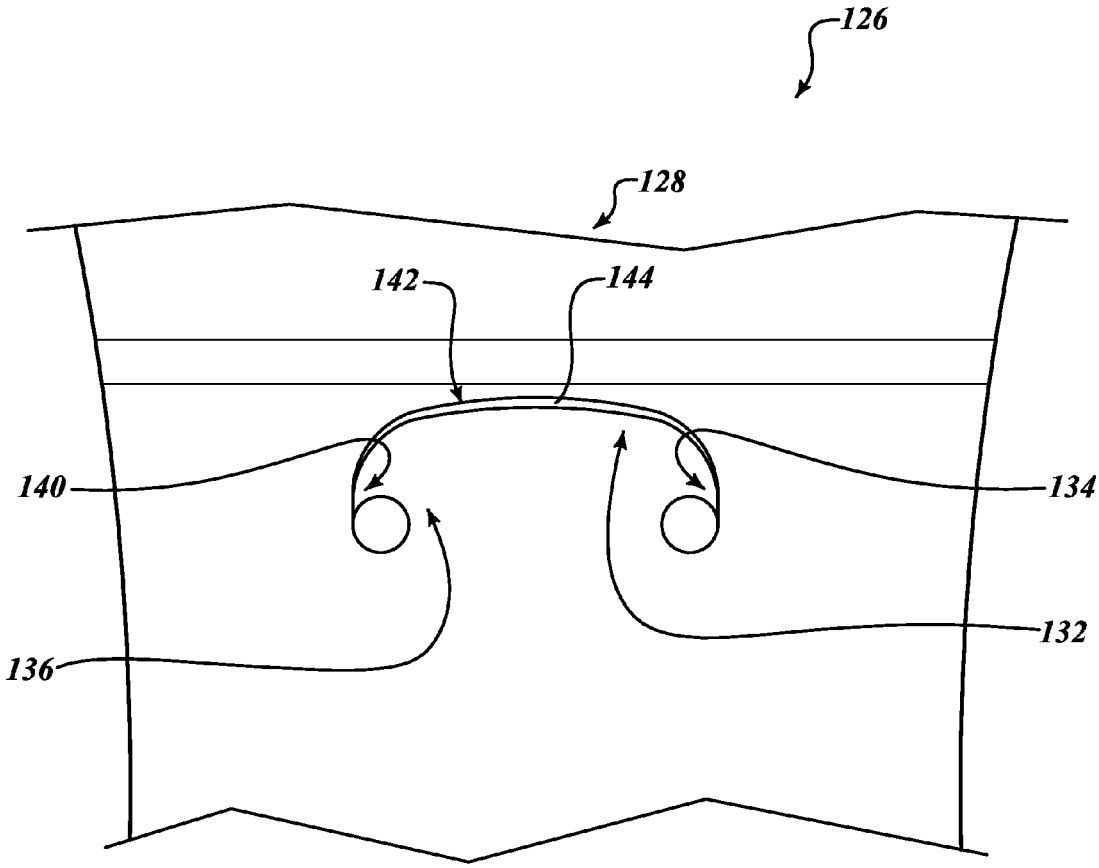
FIG. 12B is an enlarged front view of the commercial embodiment of the display card of FIG. 12A.

FIGS. 12A, 12B, 13A, and 13B illustrate a commercial embodiment of a display card system 126. FIG. 12A illustrates a panel 128 sized and shaped for the display of a pair of gloves 130, illustrated in FIG. 13A. A tab 132 having a hook portion 134 is formed in an upper half of the panel 128 to provide support for the gloves 130 when engaged with a narrow section 136 of the tab 132 (see FIGS. 13A and 13B). The gloves 130 are arranged to hang on opposite faces of the panel 128 (i.e. front and back sides of the panel), where loops 137, 138 of the gloves 130 are layered when engaged with the narrow section 136 of the tab 132. The location of the tab 132 on the panel 128 provides a sufficient amount of material to support the gloves 130 without affecting the integrity of the panel while at the same time including additional surface area for the presentation of article information.

Figure 13A:
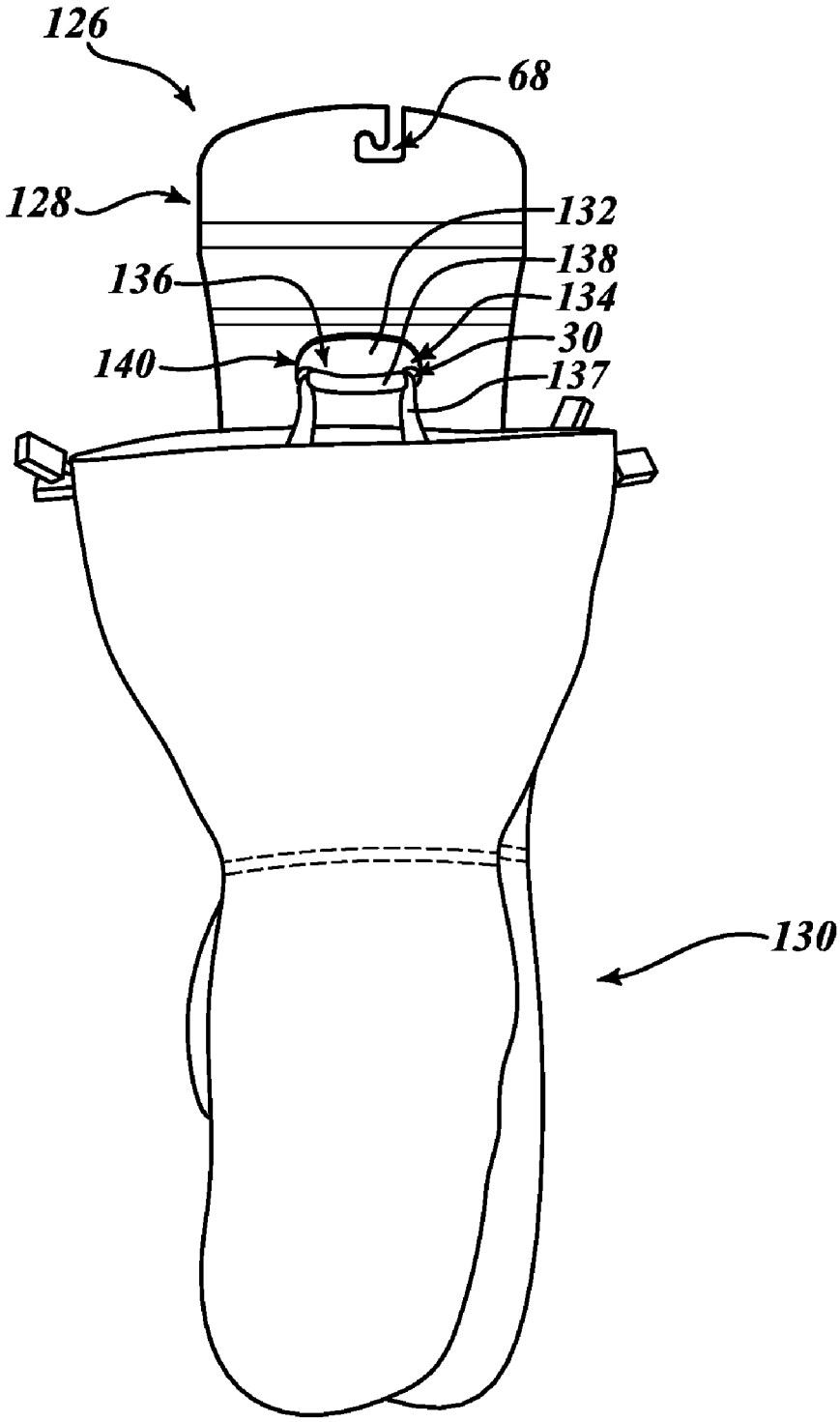
FIG. 13A is a front view of an assembled system of a commercial embodiment of the display card of FIGS. 12A and 12B.
Figure 13B:
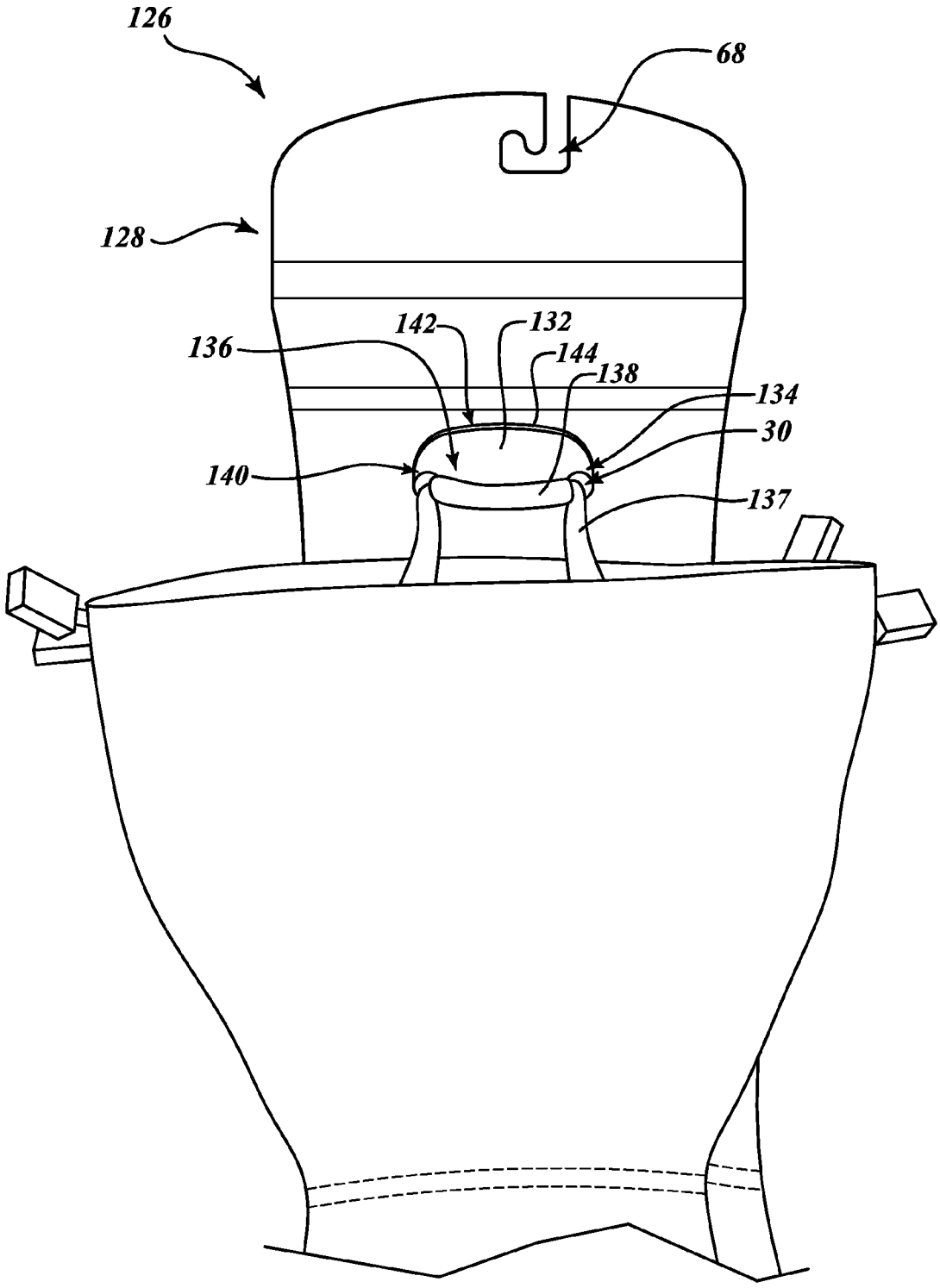
FIG. 13B is an enlarged front view of the assembled system of FIG. 13A.

An extreme point 140 of the hook portion 134 cooperates with an interior edge 142 of an opening 144 in the panel 128 to resist movement of the loops 137, 138 when engaged with or looped around the narrow section 136 (See FIGS. 13A and 13B). The loop 138 of a right hand glove is securely attached to the panel 128 first by sliding the loop 138 over the tab 132 from the back side of the panel 132. The loop 137 of a left hand glove is slid over the tab 132 from the front side of the panel. As a result the loop 138 of the right hand glove is below the loop 137 from the left hand glove.

Figure 14:
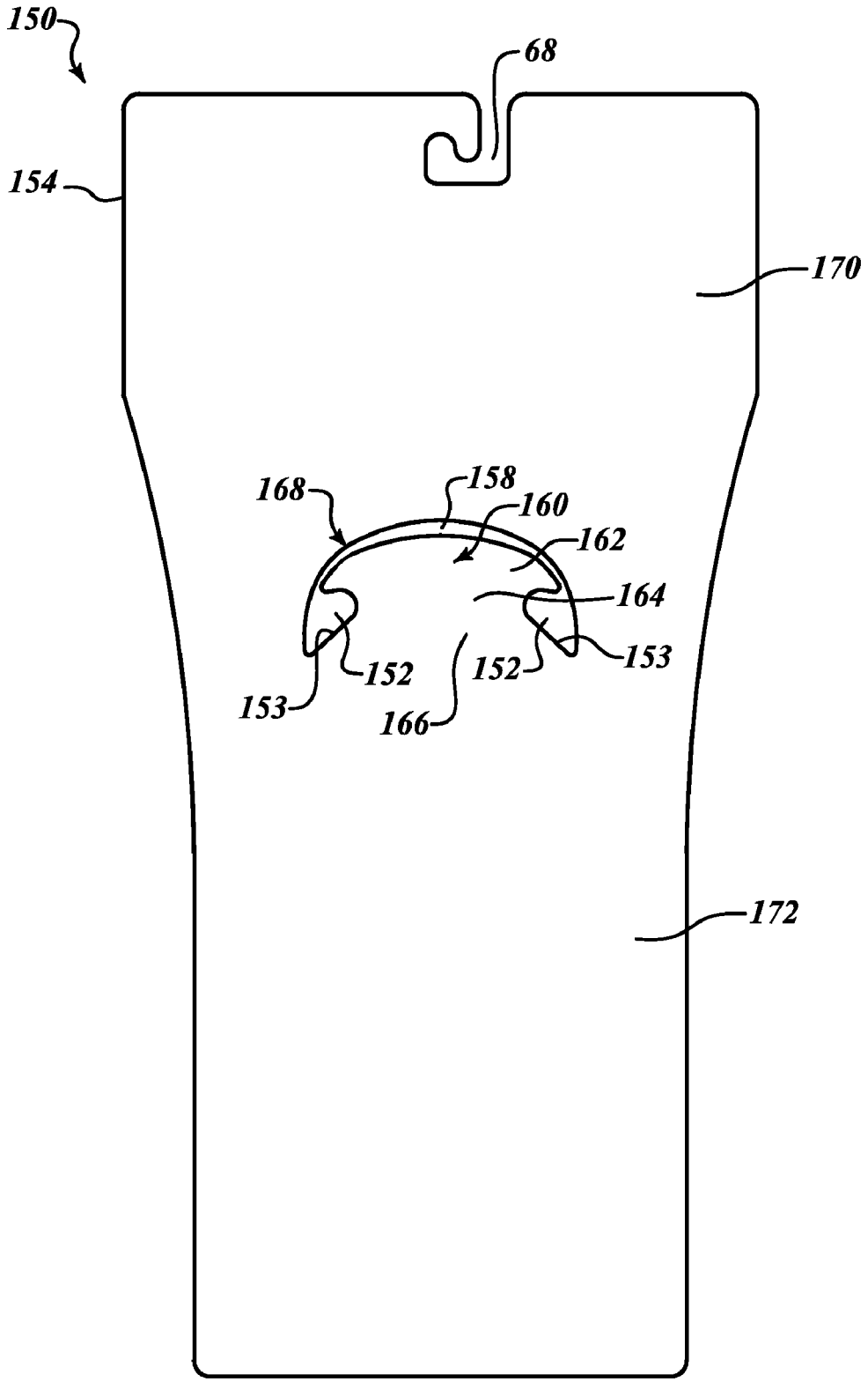
FIG. 14 is a front view of a display card according to another embodiment of the present disclosure.

FIG. 14 illustrates an alternative embodiment of a display card system 150 in which enlarged openings 152 have a different shape. Here a panel 154 is sized and shaped to be larger at a top end 170 than a bottom end 172. The top end 170 may be larger to support a variety of articles of different weights. The panel 154 may be hung or otherwise suspended for display by using an aperture 68 at the extreme top of the top end 170.

A central opening 158 is formed in the panel 154 to define a tab 160 having an upper portion 162, a narrow middle portion 164, and a wider lower portion 166. An interior edge 168 of the opening 158 has an arcuate shape that terminates adjacent the lower portion 166 of the tab 160. The lower portion 166 connects the tab 160 to the panel 154 and is the widest portion of the tab 160. The enlarged openings 152 formed at terminal ends of the central opening 158 are defined by edges 153 of the lower portion 166 that slope outwardly and downwardly from the narrow middle portion 164 to the termination of the interior edge 168. The slope of the edges of the lower portion 166 has a flat surface that better supports a loop made of a wide flat material, such as the loop 102 shown in FIG. 10A. The flat edge of the lower portion 166 enables the wide loop to smoothly engage with the tab 160 so that an associated article can hang from the tab 160 without contorting the loop. The wide upper portion 162 cooperates with an interior edge 168 to prevent the loop from inadvertent disengagement with the panel 154.

Each of the above described panels 22, 56, 128, and 154 are designed to be suspended on a display rack with positive engagement. FIGS. 9A, 9B, 12A, 12B, 13A, 13B, and 14 have the mounting aperture 68 formed on the top edge of the panels 56, 128, and 156 in a conventional manner. The aperture 68 is configured to facilitate display of the panels 56, 128, 156 on a support structure, such as a bar or horizontally oriented post. The aperture 68 is preferably formed to display the panel with an article in a balanced manner. The panels 56, 128, 156 may be engaged with a display rack by various methods including, but not limited to, positive engagement with parallel arms, single hooks, and clamps.

The tab or hooked member, formed coplanar with the panel 22, 56, 128, or 156 in conjunction with the loop that is formed as a multifaceted component of the article provides a system to display an article for sale without puncturing the article or using additional fasteners. A consumer may try the article on while the article is attached to the panel or may remove the article from the panel for a more detailed evaluation.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A panel formed of recyclable material and configured to display an article on a holder, the article having a receiving loop integrally formed thereon, the panel comprising:

an arcuate opening;

an interior edge formed by the opening; and an internal tab coplanar with the panel and extending into the opening, the opening separating the interior edge of the panel from the tab by a first distance, the tab having:

a narrow section; and at least one hook portion extending from the tab, the hook portion abutting the interior edge of the panel, the opening separating the interior edge of the panel from the hook portion by a second distance that is smaller than the first distance, the hook portion cooperating with the interior edge of the panel to allow the loop to be received over the tab and to retain the loop in engagement with the narrow section.

2. The panel of claim 1, wherein, the opening terminates at first and second enlarged openings, with each enlarged opening separating the panel from the tab by a third distance larger than the second distance.

3. The panel of claim 1, wherein the panel is formed from recyclable paper materials.

4. The panel of claim 1, wherein the panel comprises at least one aperture configured to receive a mounting device associated with the holder.

5. The panel of claim 1, wherein the shape and size of the panel is determined by the features of the article to be displayed.

6. The panel of claim 1, wherein the panel is sized and shaped to display article information.

7. The panel of claim 1, wherein the panel is configured to have multiple tabs for displaying multiple articles.

8. A device for displaying an article, the article having a receiving loop integrally formed thereon, the device comprising:

a planar panel that includes:

an opening;

an interior edge of the panel defined by the opening; and a hooked member in the same plane as the panel and defined by the opening, the hooked member having a body with an enlarged head and a smaller neck, the enlarged head separated from the interior edge of the panel by a first distance, a transition between the head and neck defining at least one hook portion that extends from the hooked member, the hook portion separated from the interior edge of the panel by a second distance that is smaller than the first distance, the hook portion cooperating with the interior edge of the panel to retain the receiving loop of the article in engagement with the hooked member.

9. The device of claim 8, wherein the panel is sized and shaped to have multiple hooked members to display multiple articles.

10. A display system, comprising:

an article to be displayed, the article comprising a receiving member formed as a component of the article; and a planar panel, including:

an opening;

an interior edge of the panel defined by the opening; and a tab coplanar with the panel and extending into the opening in the panel, the opening separating the tab from the interior edge of the panel by a first distance, the tab including:

a neck; and at least one hook portion defined by the neck and extending from the tab, the hook portion abutting the interior edge of the panel, the opening separating the hook portion from the interior edge of the panel by a second distance that is smaller than the first distance, the hook portion cooperating with the interior edge of the panel to allow the receiving member to be received over the tab and around the neck to retain the receiving member in engagement with the neck.

11. The display system of claim 10, wherein the system comprises a support structure that receives and supports the panel with the article engaged with the panel.

12. The panel of claim 11, wherein the panel is sized and shaped according to the features of the article to be displayed and the features of the support structure.

* * * * *